United States Patent [19]

Hashiguchi et al.

[11] Patent Number: 4,707,184

[45] Date of Patent: Nov. 17, 1987

[54] POROUS METAL PARTS AND METHOD FOR MAKING THE SAME

[75] Inventors: Don H. Hashiguchi, University Heights; Erhard Klar, Beachwood, both of Ohio

[73] Assignee: SCM Metal Products, Inc., Cleveland, Ohio

[21] Appl. No.: 740,088

[22] Filed: May 31, 1985

[51] Int. Cl.[4] ..... B22F 1/00

[52] U.S. Cl. ..... 75/228; 75/232; 75/235; 75/951; 419/2; 419/19; 428/547

[58] Field of Search ..... 419/30, 32, 19, 2, 228; 75/232–235, 247, 951; 428/547

[56] References Cited

U.S. PATENT DOCUMENTS

| | | | |
|---|---|---|---|
| 2,227,308 | 12/1940 | Hildabolt | 419/2 |
| 3,759,709 | 9/1973 | Asbury | 419/2 |
| 3,779,714 | 12/1973 | Nadkarni et al. | 29/182.5 |
| 3,853,551 | 12/1974 | Esper et al. | 75/227 |
| 3,861,966 | 1/1975 | Scheithauer | 75/226 |
| 3,895,942 | 7/1975 | Morse | 419/28 |
| 3,990,861 | 11/1976 | Morse | 419/32 |
| 4,232,726 | 11/1980 | Michelson | 164/12 |
| 4,291,740 | 9/1981 | Michelson | 164/7.1 |
| 4,311,184 | 1/1982 | Michelson | 164/165 |
| 4,315,777 | 2/1982 | Nadkarni et al. | 75/234 |
| 4,462,845 | 7/1984 | Klar et al. | 75/0.5 B |

*Primary Examiner*—Stephen J. Lechert, Jr.
*Attorney, Agent, or Firm*—R. A. Sturges

[57] ABSTRACT

A gas permeable or porous article of irregular configuration comprising a sintered structure of dispersion strengthened metal or metal alloy particles. The present invention also relates to a novel method for making such article.

5 Claims, No Drawings

POROUS METAL PARTS AND METHOD FOR MAKING THE SAME

TECHNICAL FIELD

The present invention relates to porous, sintered metal parts of irregular shape, and to a method for making such parts.

The present invention will be described with respect to the preparation of porous or gas permeable foundry patterns of irregular shape, although it will be apparent to those skilled in the art that the present invention has other applications, for instance the preparation of filter pieces of irregular shape, flame arrestors, and bearings.

BACKGROUND OF THE PRESENT INVENTION

Prior U.S. Pat. No. 4, 291,740 to Michelson, and related U.S. Pat. Nos. 4,232,726 and 4,311,184, describe a process for making foundry shell cores or molds, referred to as a heatless process.This process vibrates a sand/binder mix into a generally cylindrical cavity formed by a pair of gas permeable, concave patterns pressed together. A catalyst gas is then forced into the cavity through the pattern walls, causing polymerization of the binder, and, thus, hardening of the sand-/binder mix. The thickness of the layer of hardened mix depends upon the pressure of the catalyst gas employed and amount of compression of residual air in the cavity. After curing the catalyst contacted mix for a predetermined period of time, the remaining unhardened center of loose sand and unreacted binder is removed by turning the pattern box upside down and blowing out the interior with compressed air. The pattern is then opened and the resulting sand core or mold is removed.

The present invention is concerned in part with the preparation of such patterns.

In the Michelson process, as disclosed in the U.S. Pat. No. 4,291,740 patent, the patterns are made of iron or steel sheet metal with a plurality of permeable inserts positioned in the wall of the patterns in a chessboard-like, staggered arrangement. The inserts may be of the screen type.

One problem with this arrangement is that the filters tend to plug up with sand/binder mix. In addition, the use of spaced openings does not allow or provide a continuous gas permeable surface for uniform treatment of sand/binder mix.

In the U.S. Pat. No. 4,291,740 patent, it is mentioned that the patterns can be made of sintered powdered metal. Whereas such patterns are gas permeable all around and, thus, less likely to plug, such patterns, if made in complicated or irregular shape, tend to crack on outer diameters during manufacture. This is believed to be due to shrinkage during sintering. Sintering takes place at an elevated temperature which is about $\frac{2}{3}$ of absolute temperature for the metal particular, and in the process there is a general tendency for the particulates of the metal to change shape and size and generally flow closer together. The mold used to form the pattern shape, however, does not shrink, with the result that cracks in surfaces restrained by the mold surfaces develop. In one example, in the formation of a truncated cone-shaped part between two graphite mold halves, the shrinkage during sintering was so severe as to provide a strong force tending to force the two mold halves apart.

DISCLOSURE OF THE INVENTION

The present invention overcomes the above disadvantages in providing a method for the preparation of porous metal parts of irregular configuration which comprises the steps of: preparing a mold having said configuration; applying a metal or metal alloy particulate to the surface of said mold; sintering said metal or metal alloy to form a sintered structure; and separating said sintered structure from said mold; wherein the improvement comprises employing as said metal or metal alloy particulate a dispersion strengthened metal or metal alloy.

Alternatively, the process of the present invention resides in employing a mold having a same or similar coefficient of expansion as the metal or metal alloy particulate. This may be employed in combination with the use of dispersion strengthened metal or metal alloy as said particulate, or instead of such metal or metal alloy.

In the practice of the present invention, the application of metal or metal alloy particulate to the surface of a mold is carried out by either flame spraying said metal or metal alloy particulate to said surface, loose pack filling a mold space with said metal or metal alloy particulate, or applying said metal or metal alloy particulate using a no-slump fugitive vehicle paste.

The present invention also resides in a novel gas-permeable or porous article of irregular configuration comprising a sintered, porous structure of dispersion strengthened metal or metal alloy particles. Preferably, such structure has a porosity of at least about 40% on a volume basis. A characteristic of the structure of the present invention is that they are crack-free.

BEST MODE FOR CARRYING OUT THE INVENTION AND INDUSTRIAL APPLICABILITY

In the practice of the present invention, a preferred metal or metal alloy particulate is a dispersion strengthened metal or metal alloy. Dispersion strengthened metals are well known. Reference may be had to Nadkarni et al U.S. Pat. No. 3,779,714 and the references discussed in the text thereof for examples of dispersion strengthened metals, especially copper, and methods of making the dispersion strengthened metals. The disclosure of U.S. Pat. Nos. 3,799,714 is incorporated herein by reference. In this patent, dispersion strengthened copper (hereinafter also called "DSC") is produced by forming an alloy of copper as a matrix metal and aluminum as a refractory oxide forming solute metal. The alloy containing from 0.01% to 5% by weight of the solute metal is comminuted by atomization, or by conventional size reduction method to a particle size, desirably less than about 300 microns, preferably from about 5 to 100 microns, and mixed with an oxidant, for instance, copper oxide. The resultant alloy powder/oxidant mixture is then compacted prior to heat treatment or heated to a temperature sufficient to decompose the oxidant to yield oxygen to internally oxidize the solute metal to the refractory metal oxide in situ and thereby provide a very fine and uniform dispersion of refractory oxide, e.g., alumina, throughout the matrix metal. Thereafter, the preformed dispersion strengthened metal is collected as a powder or submitted to size reduction to yield a powder having a particle size of from −20 mesh to submicron size. Mechanical alloying of the matrix and solute metals, for instance, by prolonged ball milling of a powder mixture for 40–100 hours, can also be used prior to internal oxidation.

Examples of metals or metal alloys successfully dispersion strengthened are copper, copper/tin (bronze), silver, aluminum, and copper or bronze alloyed with metals such as disclosed in commonly owned U.S. Pat. No. 4,440,572 (zinc, magnesium, zirconium, beryllium, silver, chromium, iron, phosphorous, nickel, silicon and titanium). The disclosure of U.S. Pat. No. 4,440,572 is also incorporated by reference herein.

U.S. Pat. No. 3,884,676 describes dispersion strengthening of a metal in a sealed can or container. The alloy powder may be recrystallyzed prior to dispersion strengthening (U.S. Pat. Nos. 3,893,844 and 4,077,816). Other processes are disclosed in U.S. Pat. Nos. 4,274,873; 4,315,770 and 4,315,777. The disclosures of all of these U.S. patents are incorporated herein by reference. These patents are commonly owned with the present application.

In one aspect, the present invention resides in the discovery that a dispersion strengthened metal or metal alloy has very little shrinkage during sintering. Sintering is the bonding together of particles at an elevated temperature, as indicated, about $\frac{2}{3}$ of absolute temperature. It relies upon a flow of metal and diffusion of metal from one particle into an adjacent particle. The diffusion can take place in several forms, the more important ones being either surface diffusion, in which there is little dimensional change, or bulk diffusion, in which there is substantial dimensional change of the particles. Although not to be bound by any particular theory, in the present invention, with the use of dispersion strengthened metal, it is believed that the presence of the aluminum oxide, as an inert ingredient, limits the diffusion to surface diffusion, or inhibits bulk diffusion, and, thus, results in little dimensional change.

In any event, it was found that employing dispersion strengthened metals or metal alloys did tend to minimize shrinkage, during sintering to the point that complex or irregularly shaped, sintered parts could be made without the development or surface cracks.

Surface cracks can also form during the cooling step following sintering, due to a difference in the coefficient of expansion between a mold part and the applied pattern. As aspect of the practice of the present invention resides in avoiding these cracks by employing a mold part having the same or similar coefficient of expansion as the applied metal or metal alloy.

It is also an aspect of the present invention that both of the above principles can be employed, in combination, i.e., both use of a mold part of similar coefficient of expansion and use of a dispersion strengthened metal or metal alloy.

In the practice of the present invention, three methods of preparing the sintered structures of the invention have been utilized. These methods can be referred to broadly as use of flame spraying followed by sintering; use of loose-packing of particulate metal or metal alloy within a mold cavity followed by sintering; or application of the metal or metal alloy particulate to the surface of a mold in a fugitive, no-slump vehicle or paste, followed by sintering.

These three methods will each be described in detail in the following examples. In all of the examples, the criteria established for the sintered structures were based on their application or use as gas-permeable patterns for the preparation of foundry molds or foundry shell cores by the so-called heatless method. In this regard, the porous patterns should be on the order of about $\frac{1}{8}$ inch in thickness. In the so-called heatless method, the sand used has a 300–500 micrometer diameter, so that the patterns, particularly at the interface with the sand/binder mix, should have a smaller pore diameter. Porosity in the prepared parts or sintered structures should be interconnected. Preferably, the porosity, should be in the range of about 40–60% by volume, with pore diameter of less than 300 micrometers.

In the following examples, percents are by weight except with reference to porosity, wherein the percents are by volume.

EXAMPLE 1

In this example, preparation of the pattern was carried out by gravity sintering.

A $\frac{3}{8}$ inch thick graphite block was machined to form two tortuous 1/8 inch wide grooves. One groove was filled with a 90:10 premix of bronze powder made from a commercial grade of copper (100 RXH, SCM Corporation) and a commercial grade of tine (H50, SCM Corporation). The other groove was filled with a blend of 90% GlidCop AL-15 (trademark, SCM Corporation) and 10% H50 tin, with about $\frac{1}{2}$% oleic acid to prevent segregation.

GlidCop is the SCM Corporation trademark for dispersion strengthened copper. A series of grades of dispersion strengthened copper are marketed having varying percentages of aluminum oxide ranging from about 0.1% to about 0.65%. GlidCop AL-15 has 0.15% aluminum. In the sintering process, alloying of the GlidCop and tin takes place. The GlidCop materials all have particle sizes in the range of 0.1 to 180 microns. In this and the other examples of this application, the other metal components employed had a similar particle size distribution.

Both materials in the $\frac{1}{8}$ inch grooves were sintered at 1700° F. for about 15 minutes under disassociated ammonia. Sintering was effective in both instances, but the regular bronze shrank more and exhibited more distortion than the GlidCop bronze. Porosity was about 30% for the regular bronze, and about 56% for the GlidCop bronze. Pre sizes were about 100–300 micrometers, average diameter for the regular bronze, and about 200–300 micrometers average diameter for the GlidCop bronze.

This example clearly demonstrates the improved results achieved with use of a dispersion strengthened metal or metal alloy. It is surmized that in the preparation of sintered mold patterns of complicated shape, surface cracks would have developed with the use of plain bronze particles.

EXAMPLE 2

In this Example, a procedure similar to that Example 1 was employed, except that instead of a graphite block, a $\frac{3}{8}$ inch thick bronze plate was employed having two tortuous $\frac{1}{8}$ inch wide grooves. The same powder blends as in Example 1 were used.

The bronze plate was washed with fine alumina to prevent powder sintering to the plate. Sintering was performed at 1600° F. for about 15 minutes under disassociated ammonia. The GlidCop bronze did not exhibit significant shrinkage. The regular bronze powder shrank, but exhibited slightly less distortion than the same prepared in the graphite mold of Example 1. The regular bronze had about 13% porosity, with pores of about 15–300 micrometers diameter.

This Example illustrates the advantage in using a mold having a similar coefficient of expansion to that of the particulate metal being sintered.

Difficulty was experienced with the GlidCop bronze in removing it from the mold due to some sintering with the mold, requiring the need for a better parting agent than the fine alumina in this procedure.

Experiments have shown that a fine mesh power premix of a dispersion strengthened copper, before internal oxidation, instead of an already prepared dispersion strengthened copper, can be sintered in an inert atmosphere, the sintering temperature and time being sufficient to also carry out the internal oxidation to form aluminum oxide. In one instance, sintering was carried out at about 1750° F. for about 1 hour, under a nitrogen atmosphere, using a refractory boat. The powder was a −20+270 mesh GlidCop aluminum 60 powder (0.60% aluminum) having a stoichiometric amount of oxygen (e.g., $C_uO$) to form aluminum oxide in situ. This powder had a very weak sintered strength, but sufficient for the Michelson process. The part exhibited low shrinkage during sintering.

EXAMPLE 4

In this Example, application of a particular metal or metal alloy to a mold surface is carried out by employing a vehicle or paste capable of retaining its shape, and holding the particles together, even at a high temperature, for instance, sintering temperature, when the organics of the paste are volatilized off. Such a paste vehicle is disclosed in prior application Ser. No. 649,494, filed Sept. 11, 1984, now U.S. Pat. No. 4,541,876 by Jennie Shi-Lan Hwang,assigned to assignee of the present application.

As disclosed in prior application Ser. No. 649,494, now U.S. Pat. No. 4,541,876 the vehicle can comprise a hydrocarbon, either paraffinic or aromatic, (such as octadecane, mineral spirits, paraffin wax and petrolatium), with a high surface tension, non-aqueous organic liquid. The non-aqueous, organic liquid is characterized in that it has a surface tension greater than 43 dynes per centimeter at 20° C., and is effective for diminishing hot slump of the powder when it is compounded with the vehicle. Practical anti-slump agents are listed as polyos containing from 2-6 hydroxyl groups, such as ethylene glycol, diethylene glycol, propylene glycol, sorbitol, mannitol, diethanolamine, erythritol, and others.

The disclosure of prior application Ser. No. 649,494 now U.S. Pat. No. 4,541,876 dated 17 Sept. 1985, is incorporated by reference herein.

In the Example, a 90:10 bronze paste was made by blending a premix powder with the above described vehicle. The premix powder comprised 90% copper (100 RXH) and 10% tin (H50). The ratio of vehicle to bronze powder was 14:86, by weight.

The blend was applied to various unrestricted contour graphite shapes. The vehicle allowed the paste to be applied to such unrestricted contours and sintered at high temperature without falling apart even when organics were volatilized off.

Sintering was carried out at 1540° F. for about 15 minutes under disassociated ammonia atmosphere. The resultant part had 40% porosity, with an average pore diameter of about 100–300 micrometers.No slumping occurred. However, the part was dirty looking, suggesting incomplete removal of fugitive vehicle.

In a repeat test, sintering was carried out at 1700° F., also for about 15 minutes, using endo gas, producing a part that looked cleaner, but was over-sintered.

This Example demonstrates the feasibility of using a no-slump paste vehicle in the practice of the present invention. The procedure was not attempted with a dispersion strengthened metal and the Example is not intended to detract from the results and observations of Examples 1 and 2.

EXAMPLE 5

It is possible, in the procedure of Example 4, to achieve a desired shape or form by a constricted extrusion procedure, rather than applying the paste/metal blend to a desired contour. In such instance, the extrusion die constitutes the mold surface.

EXAMPLE 6

In this Example, a bronze alloy of 90% copper (100 RXH) and 10% tin (H50) premix was flame sprayed onto steel plates using acetylene and cooling air. The deposited bronze was peeled off and observed under a microscope. Porosity was found to be about 12%, with pore diameter of about 20–100 micrometers.The bronze was not alloyed. Flame spraying produced a layer of powder about ⅛ inch thick, wherein the particulates adhered together and retained the substrate contour.

After removal from the contour, the deposited bronze shape was sintered at a furnace temperature of about 1700° F. for about 15 minutes, under a disassociated ammonia atmosphere. During sintering, alloying of the copper and tin took place and porosity increased to about 18% with pore diameter decreasing to about 20–60 micrometers.

If desired, the premix powder could be blended with a soluble salt, which would volatilize on sintering, to achieve extra pore size or density control if needed.

As with Example 4, this Example simply demonstrates the feasibility of using flame spraying in the practice of the present invention, and is not intended to detract from the results and conclusions of Examples 1 and 2.

In all of the above Examples, wherein the present invention was practiced, good surface finish was obtained. The parts had good catalyst gas permeability, and good strength and wear resistance.

The present invention, in a preferred embodiment, has been described with reference to the use of a dispersion strengthened metal or metal alloy as the particular ingredient. It is also possible to achieve effective results using a plain metal or metal alloy powder in uniform dispersion with a small amount of refractory oxide, instead of a dispersion strengthened metal or metal alloy. In such case, the amount of refractory oxide used would be essentially similar or perhaps slightly more than the amount as used in a dispersion strengthened metal or metal alloy, e.g., preferably or by way of example, about 0.1% to about 1%. Particle sizes of refractory oxide and metal or metal alloy would also be about the same,e.g., less than about −325 mesh. Preparation of a uniform blend of oxide and metal or metal alloy particles would be following known procedures, for instance milling or blending with the aid of blending oils. Examples of suitable refractory oxides are aluminum oxide, silicon dioxide, magnesium oxide, and zirconium oxide. Examples of suitable metals or metal alloys are all those which may be used in powder metallurgy and are sinterable, such as copper, bronze, brass, nickel alloys, stainless steel, and low alloy steels.

Above, it was disclosed that, as a probable theory, the refractory oxide, e.g., aluminum oxide, probably was a main factor in preventing bulk diffusion during sintering. In the present instance, employing simple blend of refractory oxide and metal or metal alloy, it is believed that the same mechanism would exist; namely, resistance to bulk diffusion by the presence, at the interface of the metal or metal alloy particles, of small particles of refractory oxide; in turn resulting in minimal dimensional change.

By the term "irregular" it is meant those complex configurations that are difficult to form by conventional metallurgical techniques; e.g., that would be subject to stresses resulting from resistance to shrinkage. Constraints resulting from a mold configuration are an example.

Also, in the present application, the term "highly porous" means articles having a substantial portion of the article volume composed of interconnecting pores, such as obtainable by gravity or loose-pack sintering and flame spraying; as distinguished from an article compacted and then sintered.

What is claimed is:

1. A gas permeable or highly porous noncompacted article having a porosity of from 40% to 60% and a pore size less than 300 micrometers and being of irregular configuration comprising a sintered structure of dispersion strengthened metal or dispersion strengthened metal alloy particles.

2. The article of claim 1 wherein said particles are dispersion strengthened bronze or dispersion strengthened copper.

3. The article of claims 1 or 2 wherein said structure is a gas permeable foundry mold pattern, the pores of said pattern being interconnected, generally less than 300 micrometers in diameter, and more than 40 percent by volume of pattern volume.

4. The article of claims 1 or 2 prepared by the steps of flame spraying said particles onto a contour followed by sintering; preparing a blend of said particles with a no-slump paste vehicle and forming said paste into a desired shape; or loose-pack filling a mold space with said particles.

5. A gas permeable or highly porous article having a porosity of from 40% to 60% and a pore size of from 15 to 300 micrometers and being of irregular configuration comprising a non-compacted sintered structure made from a mixture of a metal or metal alloy powder and refractory oxide in effective amount to inhibit shrinkage during sintering.

* * * * *